US006116117A

United States Patent [19]

Nicolosi et al.

[11] Patent Number: 6,116,117

[45] Date of Patent: Sep. 12, 2000

[54] MECHANIZED SHINGLE REMOVING APPARATUS

[76] Inventors: Michael Nicolosi; William L. Bridge, Jr., both of 20 Doral Ct., Marlton, N.J. 08053

[21] Appl. No.: 09/283,744

[22] Filed: Apr. 2, 1999

[51] Int. Cl.[7] ..... E04D 15/00

[52] U.S. Cl. ..... 81/45

[58] Field of Search ..... 81/45

[56] References Cited

U.S. PATENT DOCUMENTS

| | | | |
|---|---|---|---|
| 2,245,544 | 6/1941 | Miller | 262/8 |
| 3,695,713 | 10/1972 | Rothi et al. | 299/10 |
| 3,779,605 | 12/1973 | Nieman | 299/37 |
| 4,091,535 | 5/1978 | Lehrter | 30/169 |
| 4,277,104 | 7/1981 | Sanchez | 299/37 |
| 5,218,766 | 6/1993 | Himebaugh | 30/170 |
| 5,741,047 | 4/1998 | Ordonez | 299/37.1 |
| 5,863,100 | 1/1999 | Martin | 299/37.1 |

*Primary Examiner*—James G. Smith
*Assistant Examiner*—David B. Thomas
*Attorney, Agent, or Firm*—Henderson & Sturm LLP

[57] ABSTRACT

A mechanized shingle removing apparatus 10 including a framework unit 11 including an elongated handle member which suspends a portion of a drive unit 13 beneath the distal end 25 of the handle member 20 such that the center of gravity of the drive motor 50 is disposed both above and forward of a wheel unit 12 operatively associated with the framework unit 11 such that the lifting blade member 59 of the drive unit 13 is normally biased downwardly into engagement with a roof surface; wherein in one version of the preferred embodiment, a single drive chain 51 which is aligned with the longitudinal axis of the handle member 20 is employed to raise and lower the lifting blade member 59; and, wherein in an alternate version of the preferred embodiment, a pair of laterally offset satellite drive chains 51' and 51" are employed to raise and lower the lifting blade member 59.

13 Claims, 3 Drawing Sheets

MECHANIZED SHINGLE REMOVING APPARATUS

CROSS REFERENCE TO RELATED APPLICATIONS

This application is a variation of the subject matter of our co-pending patent application, Ser. No. 09/121,642 filed Jul. 23, 1998 and entitled "Shingle Removing Apparatus".

TECHNICAL FIELD

This invention relates to the field of shingle removing apparatus in general, and in particular to a motorized shingle removing apparatus that employs a novel engine mounting arrangement.

BACKGROUND OF THE INVENTION

Description of Related Art

As can be seen by reference to the following U.S. Pat. Nos. 2,245,544; 3,695,713; 3,779,605; 4,091,535; and 4,277,104, the prior art is replete with myriad and diverse shingle removing devices.

While all of the aforementioned prior art constructions are more than adequate for the basic purpose and function for which they have been specifically designed, they are uniformly deficient with respect to their failure to provide a simple, efficient, and practical engine mounting arrangement that disposes the centerline of the engine in line with the longitudinal axis of the apparatus handle.

As any roofer is all too well aware, mechanical shingle removing devices substantially reduce the amount of physical exertion that is required to strip shingles from a roof. However, they are also cumbersome to maneuver on a roof surface due to the disposition of the motor on the apparatus framework which cause an unbalanced condition that tends to tip the ripper blade upwardly rather than facilitating the insertion of the blade under a shingle.

As a consequence of the foregoing situation, there has existed a longstanding need for a new and improved engine mounting arrangement for a shingle removing apparatus that positions the motor forward of the wheel assembly to bias the lifting blade into a downward position, and the provision of such a construction is a stated objective of the present invention.

BRIEF SUMMARY OF THE INVENTION

Briefly stated, the shingle removing apparatus that forms the basis of the present invention comprises in general, a framework unit, a wheel unit, and a drive unit. The wheel unit is disposed on the lower end of the framework unit and operatively associated with the drive unit which is mounted in a specific fashion on the framework unit such that the center of gravity of a drive motor is disposed above and forward of the wheel unit to bias the leading edge of the drive unit into a downward roof engaging disposition.

As will be explained in greater detail further on in the specification, the drive unit comprises a drive motor having a drive chain or belt that is operatively connected to a driven sprocket attached to an axle fixedly secured to a pair of end caps that are rotatably disposed on the opposite ends of a cylindrical housing.

In addition, the end caps are provided with a pair of pivoted lifter arms that are attached on their outboard ends to a lifting blade member wherein the drive motor will cause the lifter arms to raise and lower the lifting blade member to remove shingles from a roof surface.

However, the crux of the invention involves the specific placement of the drive motor, drive chain and associated drive chain housing beneath and in alignment with the distal end of the handle member to bias the lifting blade member downwardly into engagement with the roof surface wherein in one of the invention versions, a single drive chain is employed and in an alternate version of the invention, a pair of laterally offset satellite drive chains are employed to activate the lifting blade member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figures 1, 2, 3:
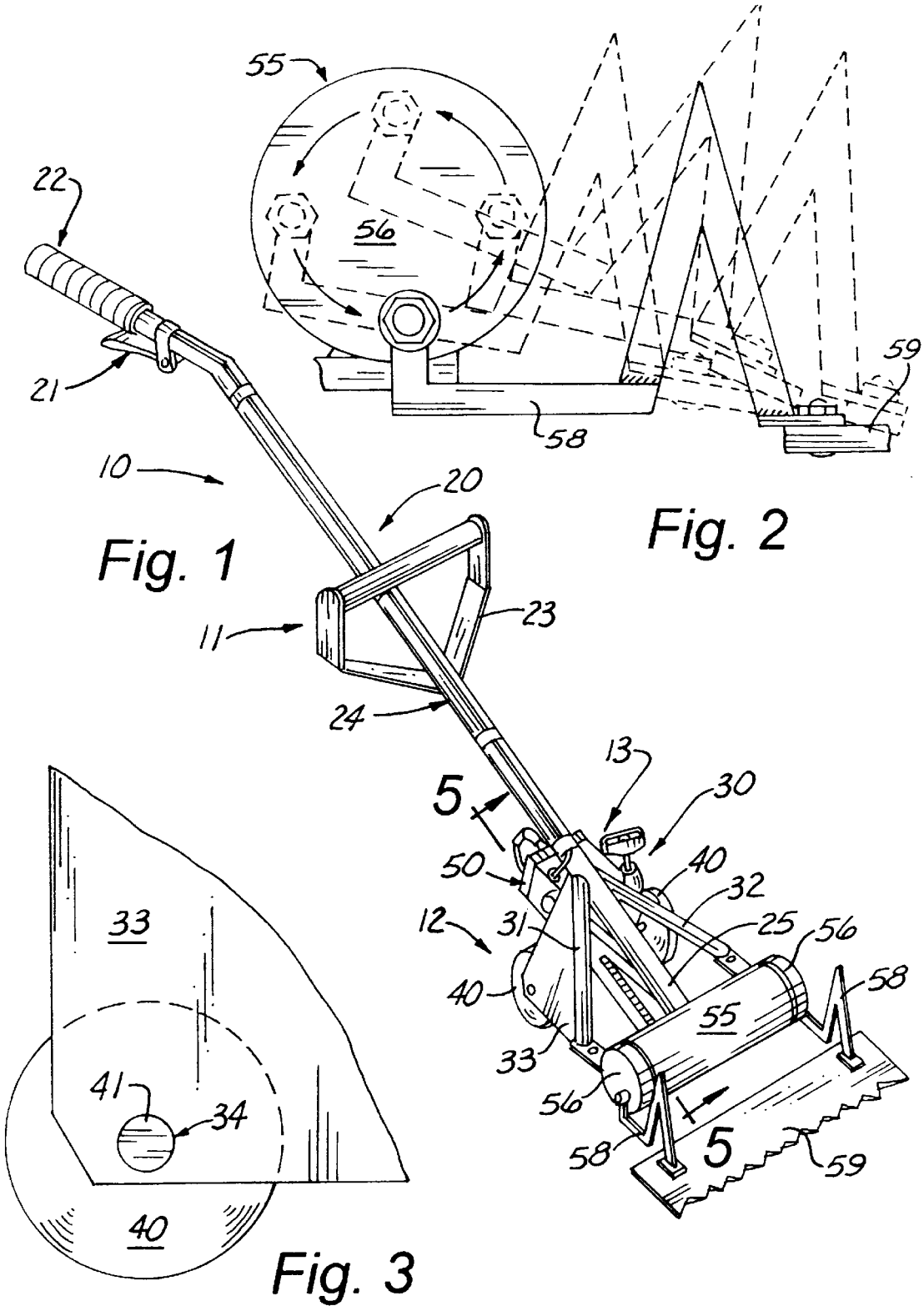
FIG. 1 a perspective view of one version of the mechanized shingle removing apparatus that forms the basis of the present invention.
FIG. 2 is an isolated side view of the lifting end of the drive unit.
FIG. 3 is an isolated side view of the wheel unit.

As can be seen by reference to the drawings, and in particularly to FIG. 1, the mechanized shingle removing apparatus that forms the basis of the present invention is designated generally by the reference number 10. The apparatus 10 comprises in general a framework unit 11, a wheel unit 12, and a drive unit 13. These units will now be described in seriatim fashion.

As shown in FIG. 1, the framework unit 11 comprises an elongated handle member 20 having a trigger mechanism 21 disposed on its proximal end 22, a hand grip element 23 disposed on its intermediate portion 24 and a framework member 30 disposed on its distal end 25. The framework member 30 comprises a pair of brace legs 31, 32 which are angled outwardly from the distal end 25 of the handle member 20 and operative associated with the drive unit 13 as will be described in greater detail further on in the specification.

Figure 4:
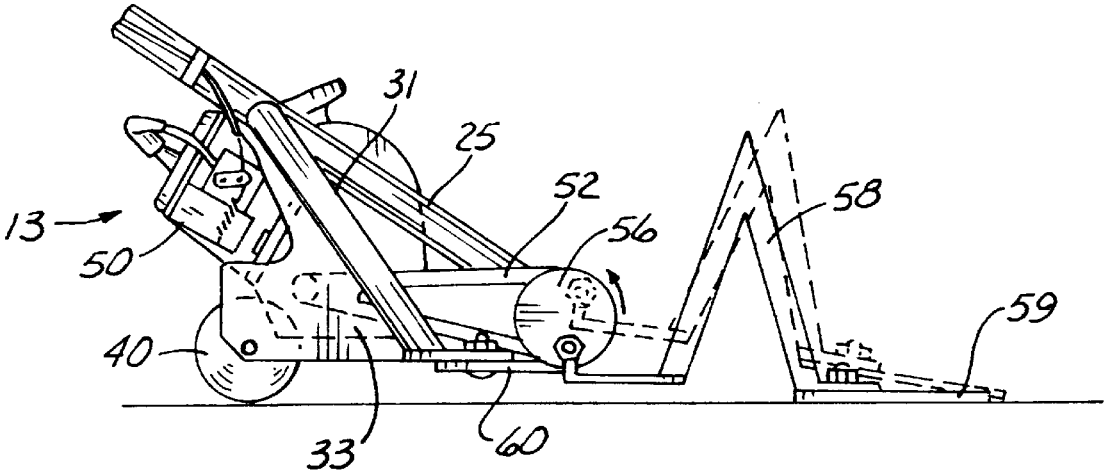
FIG. 4 is an isolated side view of the drive unit.

Turning now to FIGS. 1, 3, and 4, it can be seen that each of the brace legs 31, 32 are provided with a rearwardly extending framework panel 33 further provided with a discrete aperture 34 disposed proximate the lower end of the trailing edge of the framework panel 33 whose purpose and function will be described presently.

Still referring to FIGS. 1, 3, and 4, it can be seen that the wheel unit 12 comprises a pair of wheel members 40 mounted on an axle element 41 which extends through the discrete apertures 34 in the framework panel 33 for moving the apparatus 10 about a roof surface in a well recognized manner.

Figure 5:
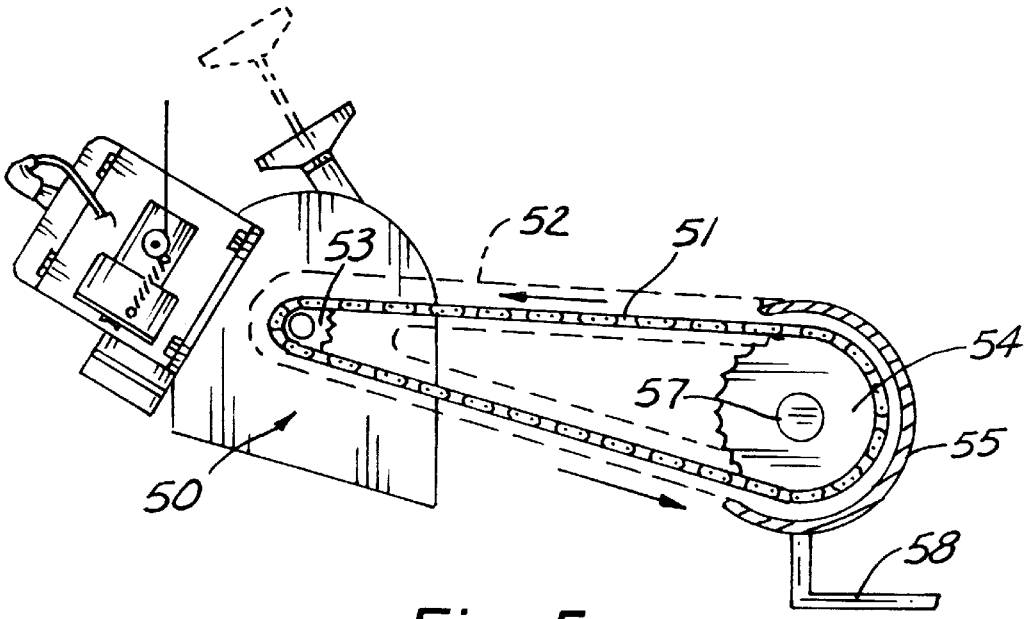
FIG. 5 is a partial cut-away view of the drive unit.

As can best be seen by reference to FIGS. 2, 4, and 5, the drive unit 13 comprises a drive motor 50 such as a gas powered two cycle engine or the like which is suspended from the framework unit 11 proximate the juncture of the angled brace legs 31, 32 with the distal end 25 of the handle member 20 such that the center of gravity of the drive motor 50 is disposed above and slightly forward of the wheel members 40 to bias the forward end of the apparatus 10 downwardly.

In addition, the drive motor 50 is operatively connected to the drive chain 51 that is contained with a housing element 52 and which extends from a drive sprocket 53 of the drive motor to an enlarged driven sprocket 54 disposed within a cylindrical housing 55 having a pair of rotating end caps 56 which are rotated by the axle element 57. Each of the rotating end caps 56 are provided with a pivoted lifter arm 58 and the outboard end of each lifter arm 58 is connected to the inboard end of a lifting blade member 59.

As can best be seen by reference to FIGS. 1 and 4, the cylinder housing 55 is further provided with a pair of rearwardly extending bracket arms 60 which are operatively secured to the angled brace legs 31, 32 to operatively support the cylinder housing 55 relative to the framework member 30.

Turning now to FIGS. 1 and 2, it can be seen that the drive unit 50 further includes a pair of leaf spring rotational stop elements 62, 62 which project outwardly and forwardly relative to the bottom portion of the cylindrical housing 55 to prevent the trailing edge of the lifting blade member 59 from passing or falling through a specific are in the clockwise direction as the pivoted lifting blade member 59 slides under and then lifts up a shingle.

As can best be seen by reference to FIG. 2, each of the lifter arms 58 have an inboard end that is freely rotatable on a pivot rod element 63 which projects outwardly relative to one of the rotating end caps 56 as the end caps 56 rotate in a counterclockwise direction relative to the cylindrical housing.

Furthermore, as shown in FIG. 1, the drive chain housing element 52 is aligned with the distal end 25 of the handle member 20 such that the weight of the drive motor 50, the drive chain 51, and the chain housing element 52 is centered beneath the longitudinal axis of the handle member 20, such that the blade member 59 is always biased downwardly in the direction of engagement with the shingles on a roof surface.

Figure 6:
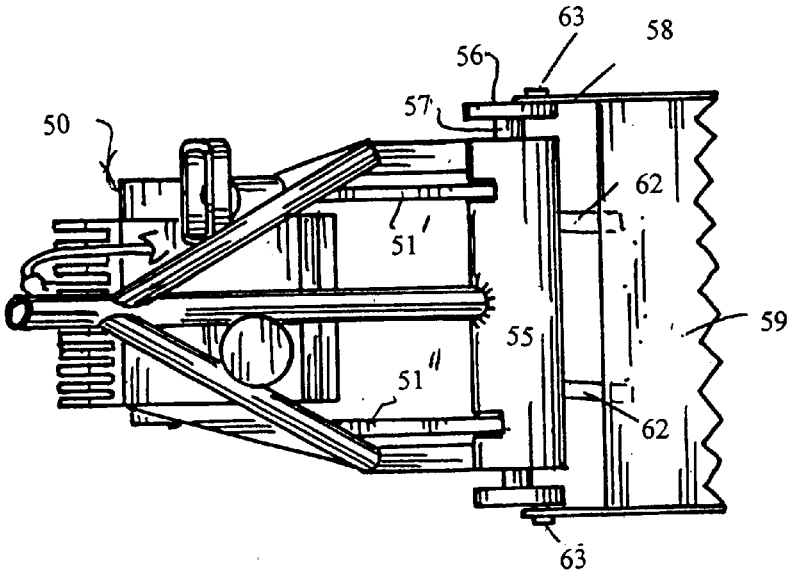
FIG. 6 is a top plan view of an alternate version of the preferred embodiment; and, FIG. 7 is a perspective view of the alternate version
Figure 7:
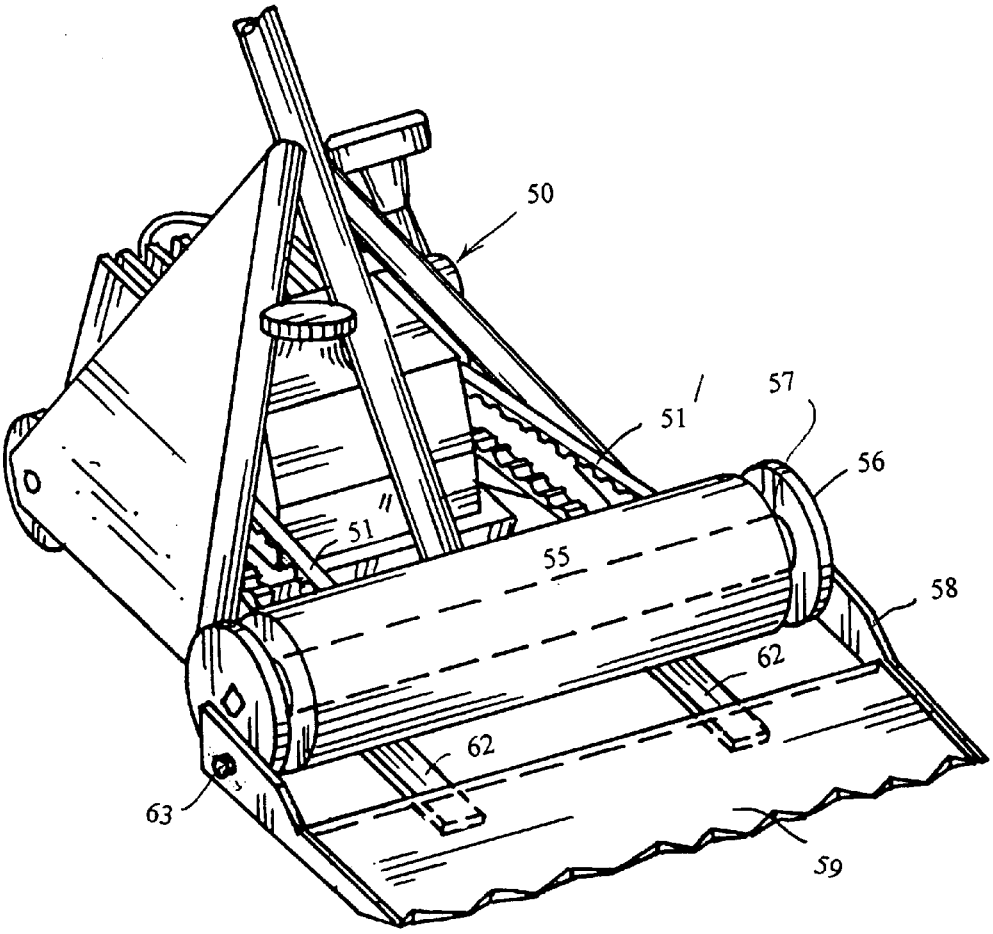

Turning now to FIGS. 6 and 7, it can be seen that in the alternate version of the preferred embodiment, the drive unit 13 comprises a drive motor 50 having a pair of laterally offset satellite drive chains 51', 51" are laterally offset from the longitudinal axis of the handle member 20 to provide a more positive dual driving force to the rotary axle element 57.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed:

1. A mechanized shingle removing apparatus comprising:

a framework unit including an elongated handle member having a proximal end, a distal end, and an intermediate position; wherein, the distal end of the handle member is provided with a framework member having a front portion and a rear portion wherein the framework member includes a pair of brace legs angled outwardly relative to the distal end of the handle member;

a wheel unit including a pair of wheel members operatively associated with the rear portion of the framework member; and a drive unit having a front end provided with a lifting blade member and a rear end provided with a drive motor operatively associated with the lifting blade wherein the center of gravity of the drive motor is disposed above and in front of said wheel members.

2. The apparatus as in claim 1 wherein the framework member further includes a pair of framework panels extending rearwardly from the pair of brace legs.

3. The apparatus as in claim 2 wherein the wheel members are disposed on the rearward portion of the framework panels.

4. The apparatus as in claim 3 wherein the drive unit further includes a drive socket extending outwardly from the drive motor and operatively engaged to one end of a drive chain which is disposed within a housing element which projects outwardly from the drive motor.

5. The apparatus as in claim 4 wherein the other end of the drive chain is operatively connected to a driven sprocket rotatably disposed within a cylindrical housing.

6. The apparatus as in claim 5 wherein the cylindrical housing is operatively connected to the framework member and provided with a pair of rotating end caps mounted on an axle that is disposed within the cylindrical housing and operatively connected to the driven sprocket.

7. The apparatus as in claim 6 wherein each of the rotating end caps are provided with a lifter arm whose outboard end is connected to the lifting blade member.

8. The apparatus as in claim 7 wherein the drive motor, the drive chain, and the drive chain housing are aligned with and disposed beneath the longitudinal axis of the handle member.

9. The apparatus as in claim 3, wherein, the drive unit further a drive socket which extends outwardly from the drive motor and is operatively engaged to one end of a pair of laterally offset satellite drive chains wherein the other end of the drive chains are operatively connected to a pair of driven sockets fixedly secured to an axle element rotatably disposed within a cylindrical housing operatively associated with the front portion of the framework member.

10. The apparatus as in claim 9, wherein, the rotating axle element is provided with a pair of end cps that are fixedly secured to the opposite ends of the axle element and which project beyond the cylindrical housing.

11. The apparatus as in claim 10 wherein the pair of end caps are pivotally connected to a pair of lifter arms having outboard ends which are fixedly secured to the lifting blade member.

12. The apparatus as in claim 11, wherein, the cylindrical housing is further provided with means for limiting the clockwise rotation of the lifting blade member relative to the cylindrical housing.

13. The apparatus as in claim 11, wherein, the cylindrical housing is further provided with at least one rotational stop element which projects outwardly from the cylindrical housing and is dimensioned to engage a portion of the lifting blade member.

* * * * *